US006382990B1

(12) United States Patent
Marechal et al.

(10) Patent No.: US 6,382,990 B1
(45) Date of Patent: May 7, 2002

(54) ELECTRIC CONNECTION BASE PLATE IN PARTICULAR FOR EXPLOSIBLE ENVIRONMENT AND METHOD FOR MAKING SAME

(75) Inventors: Gilles Marechal, Paris; Jean-Michel Vallet, Marly la Ville, both of (FR)

(73) Assignee: Societe d'Exploitation des Procedes Marechal (SEPM), Saint Maurice Cedex (FR)

( * ) Notice: Subject to any disclaimer, the term of this patent is extended or adjusted under 35 U.S.C. 154(b) by 0 days.

(21) Appl. No.: 09/600,172

(22) PCT Filed: Nov. 19, 1999

(86) PCT No.: PCT/FR99/02844

§ 371 Date: Sep. 11, 2000

§ 102(e) Date: Sep. 11, 2000

(87) PCT Pub. No.: WO00/35054

PCT Pub. Date: Jun. 15, 2000

(51) Int. Cl.[7] ..... H01R 13/44
(52) U.S. Cl. ..... 439/138; 439/142
(58) Field of Search ..... 439/138, 139, 439/142, 143, 145, 146, 147

(56) References Cited

U.S. PATENT DOCUMENTS

| | | | | |
|---|---|---|---|---|
| 2,697,212 A | * | 12/1954 | Castelli | 439/181 |
| 2,986,612 A | * | 5/1961 | Healy | 200/51 R |
| 3,330,920 A | * | 7/1967 | Appleton | 439/142 X |
| 3,475,570 A | * | 10/1969 | Appleton | 200/51.07 |
| 3,853,376 A | * | 12/1974 | Marechal | 439/139 |
| 4,203,640 A | * | 5/1980 | Bice et al. | 439/139 |
| 4,525,610 A | * | 6/1985 | Le Magourou | 439/139 X |
| 4,659,160 A | * | 4/1987 | Jonval | 439/187 |
| 4,772,215 A | * | 9/1988 | Falk | 439/188 |
| 4,780,089 A | * | 10/1988 | Wernick | 439/138 |
| 5,234,350 A | * | 8/1993 | Marechal | 439/139 |

FOREIGN PATENT DOCUMENTS

| | | |
|---|---|---|
| EP | 112258 | 6/1984 |
| FR | 2686461 | 7/1993 |
| GB | 1301448 | 7/1944 |
| GB | 2125234 | 2/1984 |

* cited by examiner

*Primary Examiner*—Brian Sircus
*Assistant Examiner*—Chandrika Prasad
(74) *Attorney, Agent, or Firm*—Greenblum & Bernstein, P.L.C.

(57) ABSTRACT

The invention provides for an electrical connection socket including an insulating block comprising a central protuberance. A plurality of peripheral contact housings are arranged in the insulating block. Each peripheral contact housing includes an electrical contact. Each peripheral contact is adapted to mate with a corresponding pin when the electrical connection socket is coupled to an electrical connection plug. A safety disk is provided having a central opening and at least a same number of peripheral through openings as there are electrical contacts. The central opening of the safety disk is adapted to receive at least a portion of the central protuberance of the insulating block. The safety disk is rotatably mounted to the insulating block so as to form explosive proof joint between at least two surfaces.

29 Claims, 5 Drawing Sheets

ELECTRIC CONNECTION BASE PLATE IN PARTICULAR FOR EXPLOSIBLE ENVIRONMENT AND METHOD FOR MAKING SAME

CROSS-REFERENCE TO RELATED APPLICATIONS

The present application is a National Stage Application of International Application No. PCT/FR99/02844, filed Nov. 19, 1999. Further, the present application claims priority under 35 U.S.C. § 119 of French Patent Application No. 98/15329 filed on Apr. 12, 1998.

BACKGROUND OF THE INVENTION

1. Field of the Invention

This invention relates to an electrical connection socket, particularly for an explosive or explodable atmosphere, for example in the form of a power connector socket or a mobile extension cable socket, and its manufacturing process.

2. Discussion of Background Information

It is already known how to manufacture an electrical connection socket provided with electrical contacts installed in contact housings of an insulating block, and which are designed to cooperate with the corresponding contact pins of a plug.

An "explosion proof" enclosure needs to be provided for each connection area in order to make a socket particularly suitable for an explosive atmosphere.

In the past, this type of explosion proof confinement was obtained using intermediate mobile contacts, for example in the form of pistons moving in translation as described in European patent 0 112 258.

However one of the difficulties with this type of device is the reliability of the disconnection time between the contact pistons and the electrical contacts between the plug and socket to prevent breaking outside the explosion proof area, particularly when the plug is extracted suddenly.

Known practice also includes a connection socket like that described in document GB 2 125 234 A that is provided with a safety disk with a peripheral opening for each peripheral contact housing in the insulating block of the socket, and that it is installed free to rotate on the insulating block through a central opening in the block, and in which the inside surface cooperates with a lateral surface of a central protuberance from the insulating block forming a rotation hub, such that the peripheral openings in the disk may be moved at will by rotating this disk with respect to the corresponding housings on the insulating block.

Furthermore, if this type of device is to be used in an explosive atmosphere, an explosion proof joint surface is created between the inside surface of the casing of the plug that is inserted in the socket, and the outside surface of an element fixed to the insulating block of the said socket.

It can then be understood that the body of the plug must fit precisely while being plugged in, to form the above-mentioned explosion proof joint surface. It is usually difficult to make a large diameter explosion proof joint and requires the use of metal parts as described here for precision reasons.

Furthermore, this part is vulnerable and the slightest damage can reduce the efficiency of the explosion proof joint surface.

SUMMARY OF THE INVENTION

The invention provides for an electrical connection socket comprising an insulating block comprising a central protuberance. A plurality of peripheral contact housings are arranged in the insulating block. Each peripheral contact housing includes an electrical contact. Each peripheral contact is adapted to mate with a corresponding pin when the electrical connection socket is coupled to an electrical connection plug. A safety disk is provided having a central opening and at least a same number of peripheral through openings as there are electrical contacts. The central opening of the safety disk is adapted to receive at least a portion of the central protuberance of the insulating block.. The safety disk is rotatably mounted to the insulating block so as to form an explosive proof joint between at least two surfaces.

The safety disk may be rotatably mounted to the insulating block so as to be movable between at least a first position wherein the peripheral openings of the safety disk are aligned with the electrical contacts, and at least a second position wherein the peripheral openings of the safety disk are not aligned with the electrical contacts.

Each electrical contact may be mounted in a corresponding peripheral contact housing in the insulating block. The central opening of the safety disk may be arranged to be rotatably disposed adjacent the central protuberance of the insulating block, such that the safety disk is free to rotate on the central protuberance of the insulating block. Each of the safety disk and insulating block may comprise an engaging surface, such that contact between at least two engaging surfaces may be adapted to form an explosion proof joint. The socket may be adapted to operate in an explosive atmosphere. The central protuberance of the insulating block may comprise a central opening adapted to receive a central pin disposed in the electrical connection plug, when the electrical connection plug is coupled to the socket.

The socket may further comprise an electrical contact disposed in the central opening of the insulating block. Each of the safety disk and the insulating block may have planar front engaging surfaces that contact each other such that at least part of these front engaging surfaces are adapted to form an explosion proof joint.

The socket may further comprise an explosion proof joint formed between at least two contact surfaces of the safety disk and the insulating block. The at least two contact surfaces may be formed between the central opening of the safety disk and a cylindrical surface of the central protuberance of the insulating block. The central protuberance of the insulating block may be integrally formed with the insulating block. The central protuberance of the insulating block may comprise an insulating material. The safety disk may comprise a peripheral annular extension which is adapted to one of cover and overlap at least a portion of the insulating block. The peripheral annular extension may rotatably engage the insulating block via at least two contact surfaces, the at least two contact surfaces forming an explosion proof joint. Each of the safety disk and insulating block may comprise at least three corresponding contact surfaces, an explosion proof joint being formed via contact between at least one surface of the safety disk and at least one surface of the insulating block.

The socket may further comprise an explosion proof joint being formed via contact between at least two surfaces of the safety disk and at least two surfaces of the insulating block, one of the at least two surfaces being movable with respect to the other. The socket may further comprise a plurality of elements, wherein each element is adapted to close a peripheral contact housing. Each element may be disposed in the insulating block and arranged adjacent an end of a corresponding electrical contact which is opposite an end which is disposed adjacent the safety disk.

The central protuberance may comprise a hub which includes at least one cylindrical surface. The hub may comprise at least one of a flared external surface and recessed inner surface. The central opening of the safety disk may comprise a surface which corresponds to the at least flared external surface of the hub. At least one of the electrical contacts may comprise an end to end pressure contact. The at least one end to end pressure contact may comprise a contact head, a braid, and a helical spring.

The insulating block may be rotatably connected to the safety disk via insert molding, the safety disk being rotatably fixed to the insulating block after the insert molding.

The invention next provides for an electrical connection socket comprising an insulating block comprising an insulating central cylindrical hub. A plurality of peripheral contact housings are arranged in the insulating housing. Each peripheral contact housing includes an electrical contact. Each peripheral contact is adapted to mate with a corresponding pin when the socket is coupled to an electrical connection plug. A safety disk is provided which comprises a central opening and at least a same number of peripheral through openings as there are electrical contacts. The central opening of the safety disk is adapted to receive at least a portion of the cylindrical hub of the insulating block. The safety disk is rotatably mounted to the insulating block such that the safety disk engages the insulating block via at least one contact area.

The at least one contact area may be defined by contact between the cylindrical hub and the central opening of the safety disk. At least another contact area may be defined by contact between a surface of the insulating block and a surface of the safety disk.

The invention further provides an electrical connection socket comprising an insulating block comprising an insulating central hub and a central contact housing adapted to receive a central electrical contact. A plurality of peripheral contact housings are arranged in the insulating block and surrounding the central electrical contact. Each peripheral contact housing includes an electrical contact. Each peripheral contact is adapted to mate with a corresponding pin when the socket is coupled to an electrical connection plug. A safety disk is provided which comprises a central opening and a plurality peripheral through openings. The central opening of the safety disk is adapted to receive at least a portion of the insulating central hub of the insulating block. The safety disk is rotatably mounted to the insulating block and forms an explosive proof joint.

In particular, this is why the invention proposes a connection socket provided with a safety disk as mentioned above, but which is particularly remarkable in that at least some of the surfaces in contact with the safety disk and the insulating block and the inside surfaces of at least some of the peripheral openings in the safety disk and the outside surfaces of the corresponding pins in the plug form the surfaces of the explosion proof joint such that at least the peripheral housings in the contact of the insulating block form at least one explosion proof enclosure.

However, it is obvious that this type of structure does have advantages for use even when there is no explosive atmosphere.

In one embodiment, the central protuberance or the hub of the insulating block may be drilled to allow passage of the central pin of the plug designed to cooperate with a contact formed in a central housing of the insulating block.

For example, the safety disk and the insulating block have plane front surfaces that come into contact with each other, and in which at least part forms an explosion proof joint surface and/or furthermore the explosion proof joint surfaces between the safety disk and the insulating block are composed at least partly of at least part of the lateral rotation surface of the insulating block hub and the inside surface of the central opening of the disk.

According to one embodiment, the safety disk is provided with a peripheral annular extension that covers part of the insulating block, at least part of the overlapping areas of the insulating block and the extension forming the rotating lateral surfaces of the explosion proof joint.

In this case and according to one embodiment, the rotating lateral surfaces of the insulating block and the safety disk formed firstly by the hub and the central opening in the disk, and secondly by the overlapping areas of the insulating block and the disk extension, are cylindrical surfaces of revolution. This type of embodiment is not compulsory since the rotating surfaces, although they must be surfaces of revolution, do not need to be cylindrical.

At least the peripheral contact housings may for example be closed at the bottom of the corresponding contacts by elements forming explosion proof joint surfaces in the housings.

Preferably, the hub of the insulating block has a flared and recessed end that holds the disk and the insulating block fixed together in translation.

According to one advantageous but not exclusive embodiment, the contacts of the socket are pressure contacts in end to end contact, each provided with a contact head, a braid and a helical spring located in the corresponding contact housing.

It is known that high precision is necessary for the interstices and the lengths of the explosion proof joints.

The invention also proposes a particular non-compulsory molding process which is remarkable in that the insulating block is insert molded in or on the safety disk, itself made in advance and acting as an insert, the necessary and adjusted interstice or clearance between surfaces of parts in contact to allow rotation of the disk on the block and to form the explosion proof joints being created by removal of material from the block after molding.

BRIEF DESCRIPTION OF THE DRAWINGS

The invention will be understood, and other specific features will be clear to the reader, from the following description with reference to the attached drawings in which.

DETAILED DESCRIPTION OF THE INVENTION

Therefore the electrical connector shown comprises a plug 1 and a socket 2.

Plug 1 is provided with contact pins such as pins 3*a*, 3*b*, 3*c* that are shown on the sectional views, and socket 2 comprises corresponding contacts 4*a*, 4*b*, 4*c*.

Figure 2:
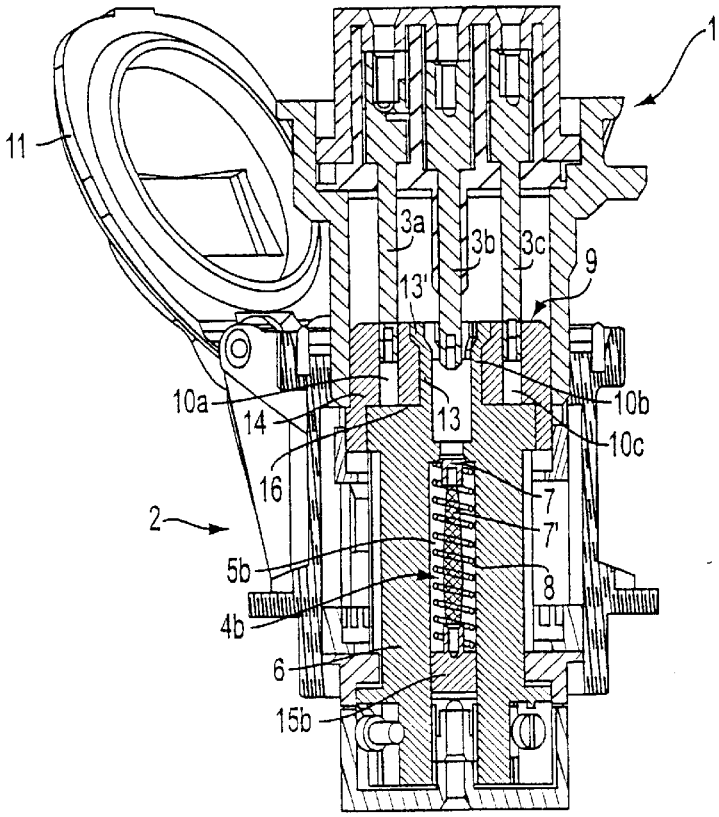
FIG. 2 is a section along II—II in FIG. 1.

Contacts 4*a*, 4*b*, 4*c* on the socket are located in housings 5*a*, 5*b*, 5*c* formed in an insulating block 6 and in this case as a non-limitative example they are in the form of end to end pressure contacts, usually each classically composed as shown by a contact head 7, a conducting braid 7' and a helical pressure spring 8 (in FIG. 2, references 7, 7' and 8 are only shown for the central contact 4*b*).

Figure 1:
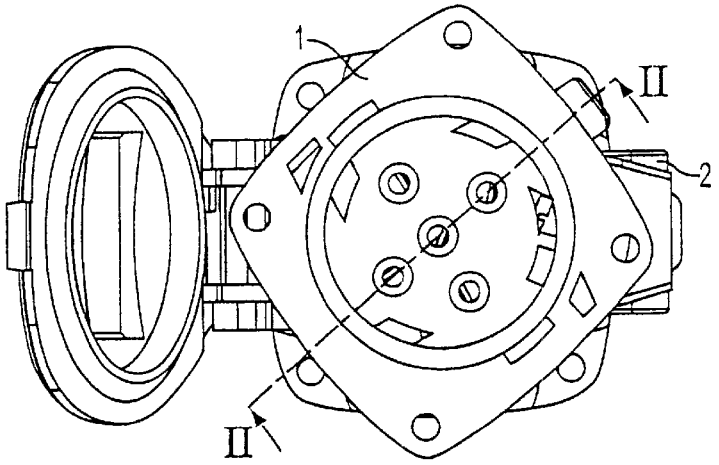
FIG. 1 is a top view of a power connector equipped with a power connector socket according to the invention and a plug in the inserted position.
Figure 3:
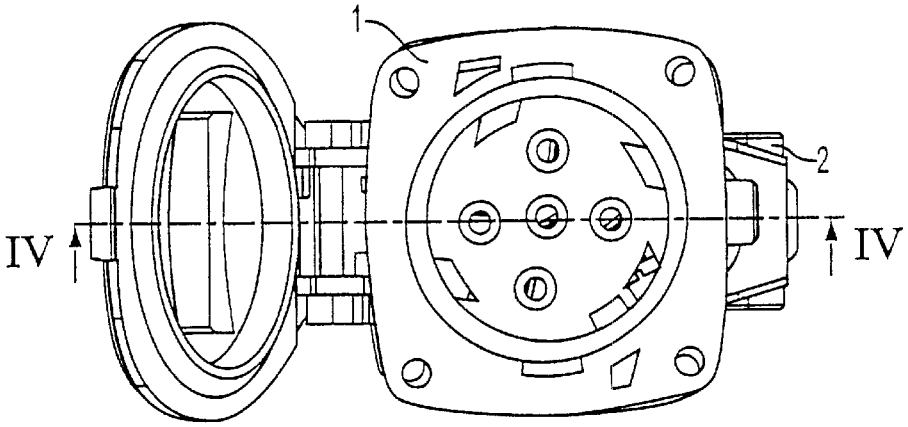
FIGS. 3 and 4 are applicable to FIGS. 1 and 2 respectively showing the plug in the position ready for connection after having been rotated (the section in FIG. 4 being along IV—IV in FIG. 3)
Figure 4:
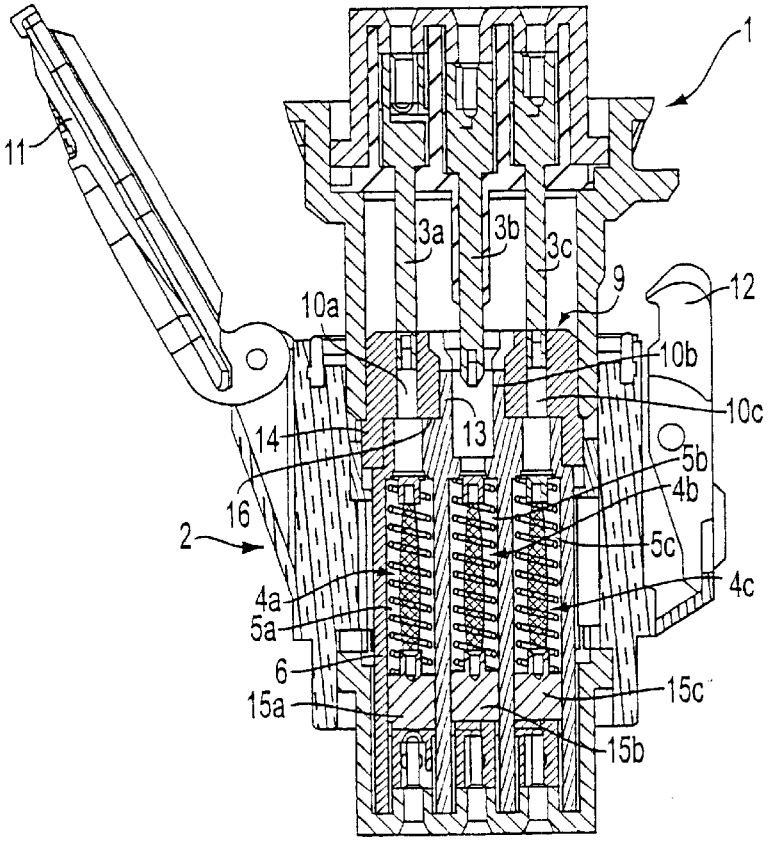
Figure 5:
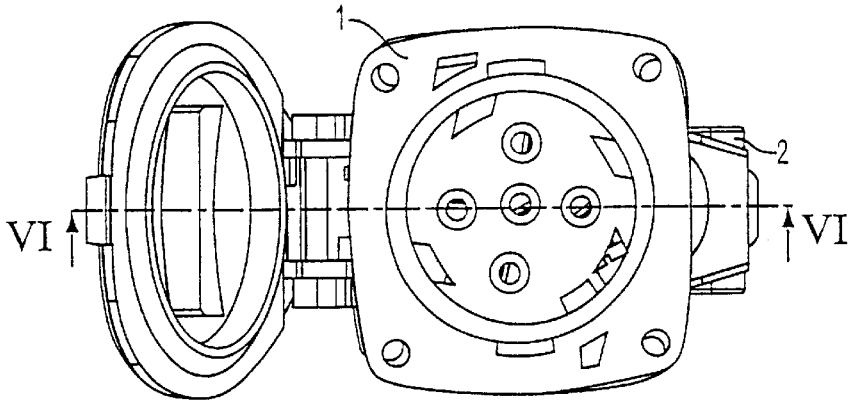
FIGS. 5 and 6 correspond to FIGS. 1 and 2 or 3 and 4 respectively, showing the plug in the connected position (the section in FIG. 6 being along VI—VI in FIG. 5)
Figure 6:
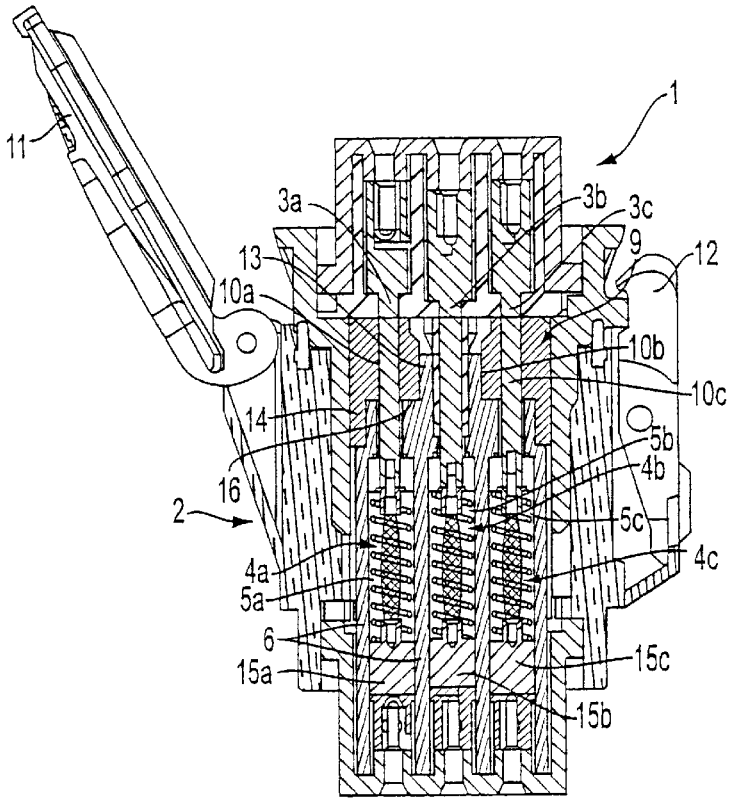

As shown in FIGS. 1, 3 and 5, in this case the plug 1 comprises five pins and obviously the same number of corresponding contacts in socket 2, but only three of these can be seen in FIGS. 4 and 6 and only one in FIG. 2.

As can be seen clearly in the Figures, the socket 2 is provided with a central housing 5*b* for a central contact 4*b* forming the earthing contact designed to cooperate with a central contact pin 3*b* of the plug, the other contacts 4*a*, 4*c*, 3*a*, 3*c* of the socket and the plug being called peripheral contacts and forming the phase or neutral contacts.

Furthermore, as clearly shown in the drawings, the socket 2 is provided with a safety disk 9 mounted free to rotate on the insulating block 6, the disk 9 being provided with the same number of openings 10*a*, 10*b*, 10*c* as the number of contacts in the plug 1 and the socket 2, since the openings are provided to allow the plug contact pins to pass through, as will be described herein.

Also as shown in the drawings, the socket 2 is provided with a protection cover 11 designed to be folded down when the plug 1 is not connected, and a hook 12 (FIGS. 4 and 6) to lock either the cover 11 or the plug 1 in the socket 2 in the connection position (FIGS. 5 and 6).

The insulating block 6 is provided with a central protuberance 13 drilled in its center forming a rotation hub for the safety disk 9 that cooperates with the hub through the inside surface of its central opening 10*b*.

The central opening 10*b* of the disk 9 and the central protuberance or hub 13 of the insulating block 6 form lateral rotation surfaces that are also at least partly cylindrical surfaces of revolution, as shown in this example.

As is clearly shown in FIGS. 2, 4 and 6, the safety disk 9 is also provided with a peripheral annular extension 14 that covers part of the insulating block 6, the areas covering the extension 14 and the insulating block 6 forming rotating cylindrical surfaces of revolution coaxial with the surfaces mentioned above.

Conventionally, in the initial position, the safety disk 9 conceals the peripheral contacts 4*a*, 4*c* of socket 2, whereas pins 3*a*, 3*b*, 3*c* in the plug may be inserted through openings 10*a*, 10*b*, 10*c* in the safety disk (FIGS. 1 and 2).

Subsequently, the plug is rotated causing rotation of the safety disk until it uncovers the peripheral contacts 4*a* and 4*c* in the socket (FIGS. 3 and 4).

All that is necessary then is to translate the plug once more so that the pins 3*a*, 3*b* and 3*c* of the plug come into contact with the corresponding contacts 4*a*, 4*b* and 4*c* of the socket when sufficient pressure is exerted to resist the force of the springs 8 fitted in them (FIG. 2), causing a slight swelling of the conducting braids 7', the plug and socket then coming into the connection position shown in FIGS. 5 and 6, the plug being locked in the socket by hook 12 (obviously, the same movements carried out in the reverse order disconnect the connection).

The protuberance 13 of the insulating block 6 is also provided with a recessed flared part 13' (FIG. 1) that moves the safety disk 9 and the insulating block 6 in translation together, and the part 13' may also be fitted with slits (clearly visible in FIG. 10) creating sectors that in particular provide some flexibility. However, according to another embodiment not shown, the protuberance 13 does not have a flared part 13', and the disk 9 is fixed by an add on clip.

Furthermore, as can be seen in FIGS. 2, 4 and 6, the peripheral openings 10*a*, 10*c* in disk 9 are a perfect fit for the contact pins 3*a*, 3*c* on plug 1.

It can be understood that the inside surface of the opening 10*b* in the disk and the outside surface of the hub 13 form lateral rotation surfaces over a certain length, like the areas overlapping the extension 14 of the disk on block 6, whereas the peripheral pins 3*a*, 3*c* of the plug pass through the calibrated openings 10*a*, 10*c* of disk 9 over a certain length.

Consequently, by choosing suitable lengths (or heights) of the above mentioned surfaces and the interstice between the surfaces, explosion proof joint surfaces can be created such that the peripheral housings 5*a*, 5*c* of the socket 2 that are the volumes within which the electrical contacts are made, form an explosion proof enclosure (see definitions below).

For this purpose, the contact housings 5*a*, 5*c* (and even 5*b* in this case) are closed at their opposite ends at contact heads by any mechanism and particularly by elements forming clamping stands for socket contacts as shown in 15*a*, 15*b* and 15*c*. In this example, these elements form the housings 15*a*, 15*b* and 15*c* of the explosion proof joint surfaces.

Note that French and European standards define an explosion proof enclosure as being a protection method in which parts that can ignite an explosive atmosphere are enclosed in an enclosure that resists the pressure developed during an internal explosion of an explosive mix, and that prevents the explosion from being transmitted to the explodable atmosphere surrounding the enclosure.

An explosion proof joint is the location at which the corresponding surfaces of two elements of an enclosure or the common part of enclosures join together to prevent the transmission of an internal explosion to the explodable atmosphere surrounding the enclosure, its length being the shortest path between the inside and outside of the enclosure.

Obviously, the interstice of an explosion proof joint is the spacing between the corresponding surfaces of the joint. For cylindrical surfaces forming cylindrical joints, the interstice is thus the difference between the diameters of the bore and the cylindrical body.

Therefore, the socket according to the invention can be explosion proof due to the creation of a common explosion proof enclosure for all peripheral contacts simply by creating explosion proof joints.

Although the example shown is applicable to a connection plug and socket for a three-phase power connection, it may be required (for example) to use the same socket (therefore with four peripheral pin passages) for a single phase current and in this case the plug is fitted with only two peripheral pins. Consequently, the invention also includes a flat explosion proof joint if necessary between the insulating block 6 and the disk 9.

As can be seen clearly on the cross-sectional drawings, the insulating block 6 and the disk 9 have plane front surfaces that are applied in contact with each other.

Figure 9:
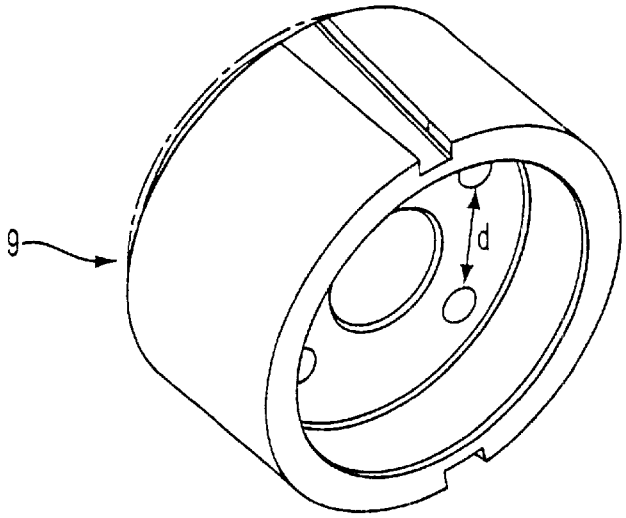
FIG. 9 is a perspective bottom view of a safety disk according to the invention.

The interstice between the surfaces combined with the distance between two peripheral housings, or similarly between two peripheral openings 10*a*, 10*c* in the safety disk 9 such as the distance shown diagrammatically as "d" in FIG. 9, is used to create a flat explosion proof joint 16 as shown in section in the Figures, that can thus create an explosion proof enclosure for each peripheral contact housing 5*b*, 5*c* such that the absence of some pins and therefore unclosed disk openings is not a problem.

Very many combinations are possible, due to the use of this type of flat explosion proof joint.

The embodiment described above includes two cylindrical explosion proof joints (hub 13 and extension 14), apart from the joints formed by the pins themselves, and possibly a flat explosion proof joint 16 that is used to make an explosion proof enclosure for each peripheral electrical contact.

However, it can be understood that if the radial distance between peripheral openings 10*a*, 10*c* in the safety disk 9 and the protuberance 13 forming the hub is sufficiently large, the flat explosion proof joint 16 produced mechanism, that it is not essential to have a cylindrical explosion proof joint formed by the protuberance.

Similarly, if the radial distance between the peripheral openings and the outside is sufficiently large, the other explosion proof cylindrical joint can also be deleted and therefore the extension 14 of the disk 9 can also be eliminated.

Therefore, there are several possibilities for making a connection socket for an explosive atmosphere; two explosion proof cylindrical joints with or without a flat explosion proof joint, or a single flat explosion proof joint, or a flat explosion proof joint and a single cylindrical explosion proof joint, either on the protuberance side or on the disk extension side.

However, if the required interstices (for example 0.1 mm) are relatively easy to obtain between the pins 3*a*, 3*c* of the plug and the corresponding openings of the disk, the adjustment between the disk rotation surface and the surface of the insulating block is undoubtedly more difficult.

Furthermore, the invention includes an innovative insert molding process, although this is not compulsory.

Figure 10:
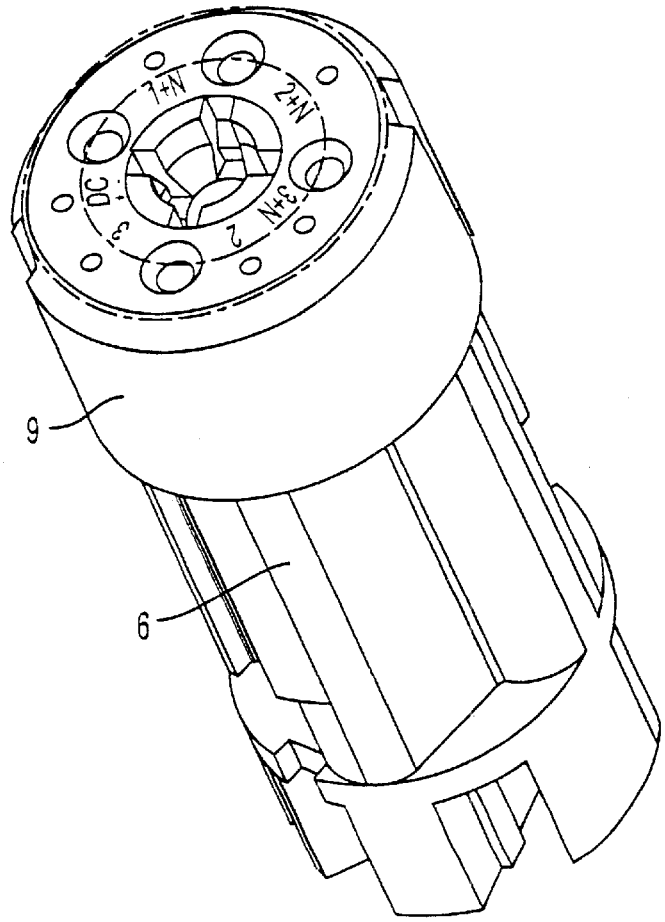
FIG. 10 is a perspective top view of the insulating block and its safety disk.

In the process according to the invention, the first step is to make the safety disk shown in FIGS. 2, 4 and 6, and particularly in FIGS. 9 and 10, for example by molding and particularly using a thermosetting material.

Figure 7:
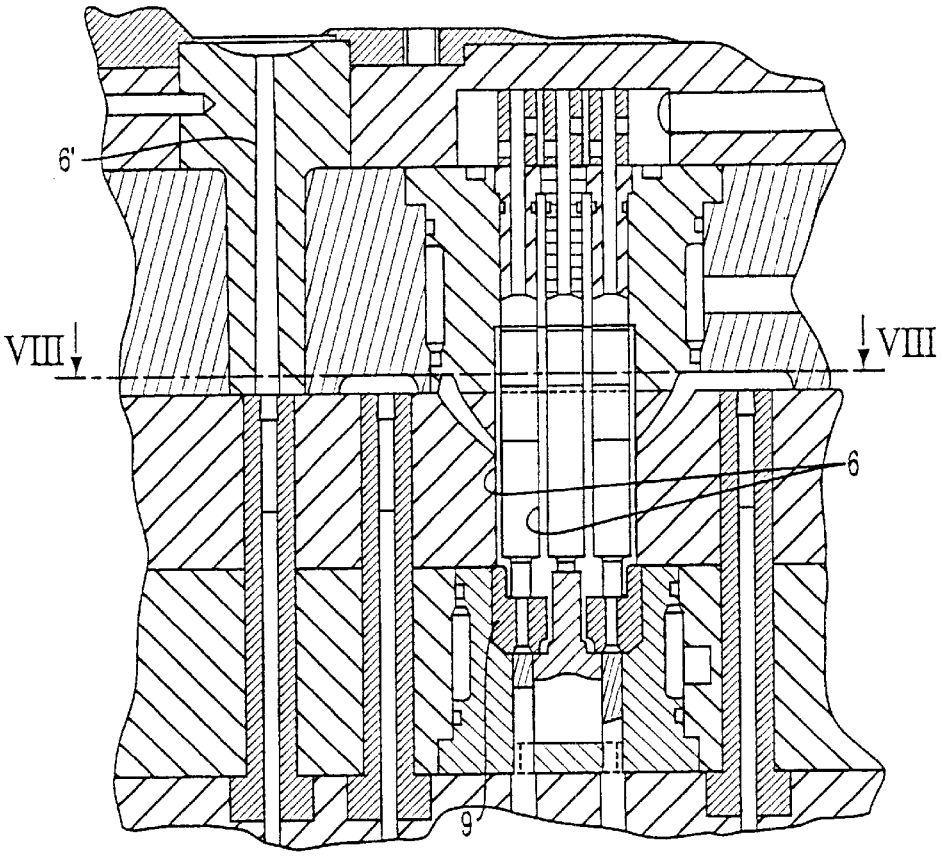
FIG. 7 diagrammatically shows a manufacturing process by insert molding the insulating block of the socket in the safety disk.
Figure 8:
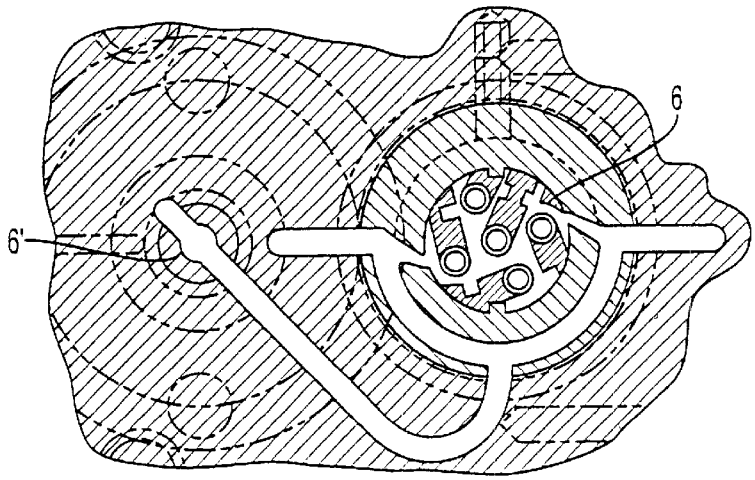
FIG. 8 is a sectional view along VIII—VIII in FIG. 7.

The next step is to make and/or connect the insulating block 6 on and/or with the disk 9 used as an insert, by insert molding as shown in FIGS. 7 and 8. The injected material 6' used to obtain the block 6, for example, a thermoplastic passes through appropriate injection ducts as shown in the drawings.

Consequently, shrinkage of the material 6' after the insulating block has been molded provides the necessary interstice for the disk 9 to rotate on the block and to form the explosion proof joint(s).

It can thus be understood that the two parts 6 and 9 are necessarily well adjusted to the need even when tolerances for the safety disk 9 itself are large.

FIG. 9 shows the safety disk 9 actually in the form of a cap due to its annular peripheral extension 14, FIG. 10 shows the result obtained for block 6 and disk 9 after insert molding, or after assembly of the parts molded separately.

What is claimed is:

1. An electrical connection socket comprising:

an insulating block comprising a surface and a central protuberance which extends beyond the surface;

a plurality of peripheral contact housings arranged in the insulating block around the central protuberance, the peripheral contact housings opening out to the surface;

each peripheral contact housing including an electrical contact;

each peripheral contact being adapted to mate with a corresponding pin when the electrical connection socket is coupled to an electrical connection plug;

a safety disk comprising a central opening and at least a same number of peripheral through openings as there are electrical contacts; and the central opening of the safety disk being adapted to receive at least a portion of the central protuberance of the insulating block, wherein the safety disk is rotatably mounted to the insulating block so as to form an explosive proof joint between at least two surfaces.

2. The socket of claim 1, wherein each electrical contact is mounted in a corresponding peripheral contact housing in the insulating block.

3. The socket of claim 1, wherein the central opening of the safety disk is arranged to be rotatably disposed adjacent the central protuberance of the insulating block, such that the safety disk is free to rotate on the central protuberance of the insulating block.

4. The socket of claim 1, wherein each of the safety disk and insulating block comprises an engaging surface, and wherein contact between at least two engaging surfaces is adapted to form an explosion proof joint.

5. The socket of claim 1, wherein the socket is adapted to operate in an explosive atmosphere.

6. The socket of claim 1, wherein the central protuberance of the insulating block comprises a central opening adapted to receive a central pin disposed in the electrical connection plug, when the electrical connection plug is coupled to the socket.

7. The socket of claim 6, further comprising an electrical contact disposed in the central opening of the insulating block.

8. The socket of claim 1, wherein each of the safety disk and the insulating block have planar front engaging surfaces that contact each other such that at least part of these front engaging surfaces are adapted to form an explosion proof joint.

9. The socket of claim 1, further comprising an explosion proof joint being formed between at least two contact surfaces of the safety disk and the insulating block.

10. The socket of claim 9, wherein the at least two contact surfaces are formed between the central opening of the safety disk and a cylindrical surface of the central protuberance of the insulating block.

11. The socket of claim 1, wherein the central protuberance of the insulating block is integrally formed with the insulating block.

12. The socket of claim 1, wherein the central protuberance of the insulating block comprises an insulating material.

13. The socket of claim 1, wherein the safety disk comprises a peripheral annular extension which is adapted to one of cover and overlap at least a portion of the insulating block.

14. The socket of claim 13, wherein the peripheral annular extension rotatably engages the insulating block via at least two contact surfaces, the at least two contact surfaces forming an explosion proof joint.

15. The socket of claim 1, wherein each of the safety disk and insulating block comprises at least three corresponding contact surfaces, an explosion proof joint being formed via contact between at least one surface of the safety disk and at least one surface of the insulating block.

16. The socket of claim 1, further comprising an explosion proof joint being formed via contact between at least two surfaces of the safety disk and at least two surfaces of the insulating block, one of the at least two surfaces being movable with respect to the other.

17. The socket of claim 1, further comprising a plurality of elements, wherein each element is adapted to close a peripheral contact housing.

18. The socket of claim 17, wherein each element is disposed in the insulating block and arranged adjacent an end of a corresponding electrical contact which is opposite an end which is disposed adjacent the safety disk.

19. The socket of claim 1, wherein the central protuberance comprises a hub which includes at least one cylindrical surface.

20. The socket of claim 19, wherein the hub comprises at least one of a flared external surface and recessed inner surface.

21. The socket of claim 20, wherein the central opening of the safety disk comprises a surface which corresponds to the at least flared external surface of the hub.

22. The socket of claim 1, wherein at least one of the electrical contacts comprises an end to end pressure contact.

23. The socket of claim 22, wherein the at least one end to end pressure contact comprises a contact head, a braid, and a helical spring.

24. The socket of claim 1, wherein the insulating block is rotatably connected to the safety disk via insert molding, the safety disk being rotatably fixed to the insulating block after the insert molding.

25. The socket of claim 1, wherein the safety disk is rotatable on the insulating block so as to be movable between at least a first position wherein the peripheral openings of the safety disk are aligned with the electrical contacts, and at least a second position wherein the peripheral openings of the safety disk are not aligned with the electrical contacts.

26. An electrical connection socket comprising:

an insulating block comprising a surface and a central cylindrical hub protruding beyond the surface;

a plurality of peripheral contact housings arranged in the insulating block, the peripheral contact housings opening out to the surface;

each peripheral contact housing including an electrical contact;

each peripheral contact being adapted to mate with a corresponding pin when the socket is coupled to an electrical connection plug;

a safety disk comprising a central opening and at least a same number of peripheral through openings as there are electrical contacts; and the central opening of the safety disk being adapted to receive at least a portion of the central cylindrical hub of the insulating block, wherein the safety disk is rotatably mounted to the insulating block such that the safety disk engages the insulating block via at least one contact area to form an explosive proof joint.

27. The socket of claim 26, wherein the at least one contact area is defined by contact between the central cylindrical hub and the central opening of the safety disk.

28. The socket of claim 27, wherein at least another contact area is defined by contact between a surface of the insulating block and a surface of the safety disk.

29. An electrical connection socket comprising:

an insulating block comprising a surface and an insulating central hub and a central contact housing adapted to receive a central electrical contact;

a plurality of peripheral contact housings arranged in the insulating block and surrounding the central electrical contact, the peripheral contact housings opening out to the surface;

each peripheral contact housing including an electrical contact;

each peripheral contact being adapted to mate with a corresponding pin when the socket is coupled to an electrical connection plug;

a safety disk comprising a central opening and a plurality peripheral through openings; and the central opening of the safety disk being adapted to receive at least a portion of the insulating central hub of the insulating block, wherein the safety disk is rotatably mounted to the insulating block and forms an explosive proof joint.

* * * * *